US010323363B1

(12) United States Patent
Jorgensen

(10) Patent No.: US 10,323,363 B1
(45) Date of Patent: Jun. 18, 2019

(54) ANGLED MAIN SCREED FOR IMPROVED MATERIAL FLOW

(71) Applicant: Caterpillar Paving Products Inc., Brooklyn Park, MN (US)

(72) Inventor: John E. Jorgensen, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/959,431

(22) Filed: Apr. 23, 2018

(51) Int. Cl.
*E01C 19/42* (2006.01)
*E01C 19/48* (2006.01)

(52) U.S. Cl.
CPC ..... *E01C 19/42* (2013.01); *E01C 19/4873* (2013.01); *E01C 2301/16* (2013.01)

(58) Field of Classification Search
CPC ... E01C 19/42; E01C 19/4873; E01C 2301/16
USPC ..... 404/118
See application file for complete search history.

(56) References Cited

U.S. PATENT DOCUMENTS 1,773,431 A * 8/1930 Mosel ..... E01C 19/42 404/119
3,680,451 A * 8/1972 Birtchet ..... E01C 19/187 404/104
4,379,653 A 4/1983 Brown
4,688,965 A * 8/1987 Smith ..... E01C 19/42 404/118
4,702,642 A * 10/1987 Musil ..... E01C 19/405 404/118
5,203,642 A * 4/1993 Heller ..... E01C 19/40 404/118
5,215,404 A 6/1993 Raymond
5,344,254 A * 9/1994 Sartain ..... E01C 19/48 404/104
5,484,227 A * 1/1996 Ikeda ..... E01C 19/006 404/118
5,863,149 A 1/1999 Gustin
6,106,192 A 8/2000 Hargis et al.
6,203,243 B1 3/2001 Birtchet
8,657,527 B2 * 2/2014 Angernnann ..... E01C 19/4873 404/118
9,683,337 B2 * 6/2017 Ellwein ..... E01C 19/4873
2016/0122954 A1 * 5/2016 Comer ..... E01C 19/48 404/118

* cited by examiner

*Primary Examiner* — Raymond W Addie
(74) *Attorney, Agent, or Firm* — Harrity & Harrtity LLP

(57) ABSTRACT

A rear mount screed assembly may include a main screed comprising a front face and an angled end face. An angle between a plane of the front face of the main screed and a plane of the angled end face of the main screed may be less than 90 degrees. The rear mount screed assembly may include a screed extension arranged behind the main screed relative to a direction in which the rear mount screed assembly is to be moved during operation.

20 Claims, 4 Drawing Sheets

ANGLED MAIN SCREED FOR IMPROVED MATERIAL FLOW

TECHNICAL FIELD

The present disclosure relates generally to a main screed included in a rear mount screed assembly and, more particularly, to a main screed, included in a rear mount screed assembly, that has angled end faces in order to provide improved material flow at or near ends of the main screed.

BACKGROUND

A paving machine can be used in the laying of bituminous roadway mat. The typical paving machine employs a screed assembly (sometimes referred to as a floating screed) for spreading and compressing a bituminous material to form a smooth surfaced roadway mat. The screed assembly typically has a set of screed extensions, slidingly attached to a main body of the screed assembly (herein referred to as a main screed), that allow an operator to control and % or select a width of the screed assembly. These screed extensions are typically connected to a linear power source (e.g., a bi-directional hydraulic cylinder or other similar activator), which is selectively operable in response to controls disposed at an operator control station. This permits the operator to control the position of the screed extensions in response to changing requirements as the paving machine progresses. For example, this permits the operator to accommodate obstacles in the path of the paving machine (e.g., sewer drains, manhole covers, and/or the like) and also permits overwidth paving of the road surface to accommodate roadway features (e.g., driveway entrances, tie-ins, and/or the like). The screed assembly can be a rear mount screed assembly (i.e., a screed assembly in which the screed extensions are mounted behind the main screed relative to the direction of travel of the paving machine) or a front mount screed assembly (i.e., a screed assembly in which the screed extensions are mounted in front of the main screed relative to the direction of travel of the paving machine).

The paving machine typically includes a storage means for receiving and containing a discreet quantity of loose bituminous aggregate material, and a material flow means for conveying the bituminous aggregate material to the roadbed. The loose material is then displaced laterally in front of the screed assembly. As the paving machine progresses along the roadbed, the screed assembly engages the loose material, plowing under and compressing the material into the desired roadway mat. Typically, endgates are provided on outer, distal ends of the screed extensions in order to ensure that the material disposed in front of the screed extensions is not shunted aside, beyond the width of the screed assembly. In some cases, means for providing the lateral disposition of the material is a flighted auger providing two oppositely directed flights from a centerline of the paving machine (e.g., in order to provide disposition of an equal amount of material toward each outer edge of the screed assembly). However, the arrangement of the main screed and the screed extensions can introduce material segregation and/or material flow issues that can negatively impact a quality of the roadway mat leveled by the screed assembly.

One attempt to address one such issue, "streaking" in the roadway mat, is disclosed in U.S. Pat. No. 6,106,192 that issued to Blaw-Knox Construction Equipment Corp. on Aug. 22, 2000 ("the '192 patent"). Per the '192 patent, streaking occurs when a section of the roadway mat appears brighter in appearance or "shinier" than other portions of the roadway mat, and occurs in sections of the roadway mat that are leveled by a region of a front mount screed assembly at transitions from inner ends of the screed extensions to outer ends of a main screed. The '192 patent postulates that streaking occurs due to fine particles of the material tending to accumulate at the inner ends of the screed extensions (such that the streaked sections are formed with a higher concentration of fine-grained material), and/or due to the outer sections of the roadway mat being leveled by the screed extensions prior to an inner section being leveled by the main screed. The '192 patent discloses a flow modifying device, for use in a front mount screed assembly, that includes a deflector member connected with a screed extension and having a flow surface facing toward a central axis of a main screed. Per the '192 patent, the flow surface is contactable with paving material and is configured to displace the material toward the central axis when the paving machine moves in the intended travel direction.

While the flow modifying device of the '192 patent is aimed to address streaking caused by use of a front mount screed, the flow modifying device does not address material segregation and/or material flow issues seen with the use of a rear mount screed assembly. For example, in a rear mount screed, the main screed has a sharp (e.g., 90 degree, square, perpendicular, and/or the like) corner and end face at ends of the main screed. In operation, as material flows around and/or near these sharp corners of the main screed, the material may be pinched between an end face of the main screed and an endgate of the screed extension. Such pinching can result in increased wear on a component of the rear mount screed assembly (e.g., the end face of the main screed, the endgate, and/or the like) and/or material segregation at or near the corner of the main screed. Further, when the screed extension is retracted from an extended position (e.g., due to a change in a desired width of the roadway mat), the retraction of the rear mount screed assembly can be impeded when, for example, the material is compressed between the end face and the endgate such that the screed extension binds, stalls, and/or is otherwise rendered unable to retract to a desired position.

The main screed with angled end faces of the present disclosure can be used in a rear mount screed assembly in order to solve one or more of the problems set forth above and/or other problems in the art.

SUMMARY

In one aspect, the present disclosure is related to a paving machine including a rear mount screed assembly including a main screed and a screed extension, the main screed including a front face and an angled end face, wherein an angle between a plane of the front face of the main screed and a plane of the angled end face of the main screed is less than 90 degrees, and the screed extension being behind the main screed relative to a direction in which the paving machine is to travel during operation.

In another aspect, the present disclosure is related to a rear mount screed assembly including a main screed comprising a front face and an angled end face, wherein an angle between a plane of the front face of the main screed and a plane of the angled end face of the main screed is less than 90 degrees; and a screed extension arranged behind the main screed relative to a direction in which the rear mount screed assembly is to be moved during operation.

In yet another aspect, the present disclosure is related to a screed assembly including a main screed and a screed extension, wherein the main screed includes a front face and an end face, wherein the end face is angled such that the end face is non-perpendicular to the front face of the main screed, and wherein the screed extension is arranged behind the main screed relative to a direction in which the screed assembly is to be moved during operation.

DETAILED DESCRIPTION

This disclosure relates to a main screed, included in a rear mount screed assembly, that has angled end faces in order to improve material flow. The main screed with the angled end faces (herein referred to as an angled main screed) has universal applicability to any machine utilizing a rear mount screed. The term "machine" may refer to any machine that performs an operation associated with an industry, such as, paving, mining, construction, farming, transportation, or any other industry.

Figure 1:
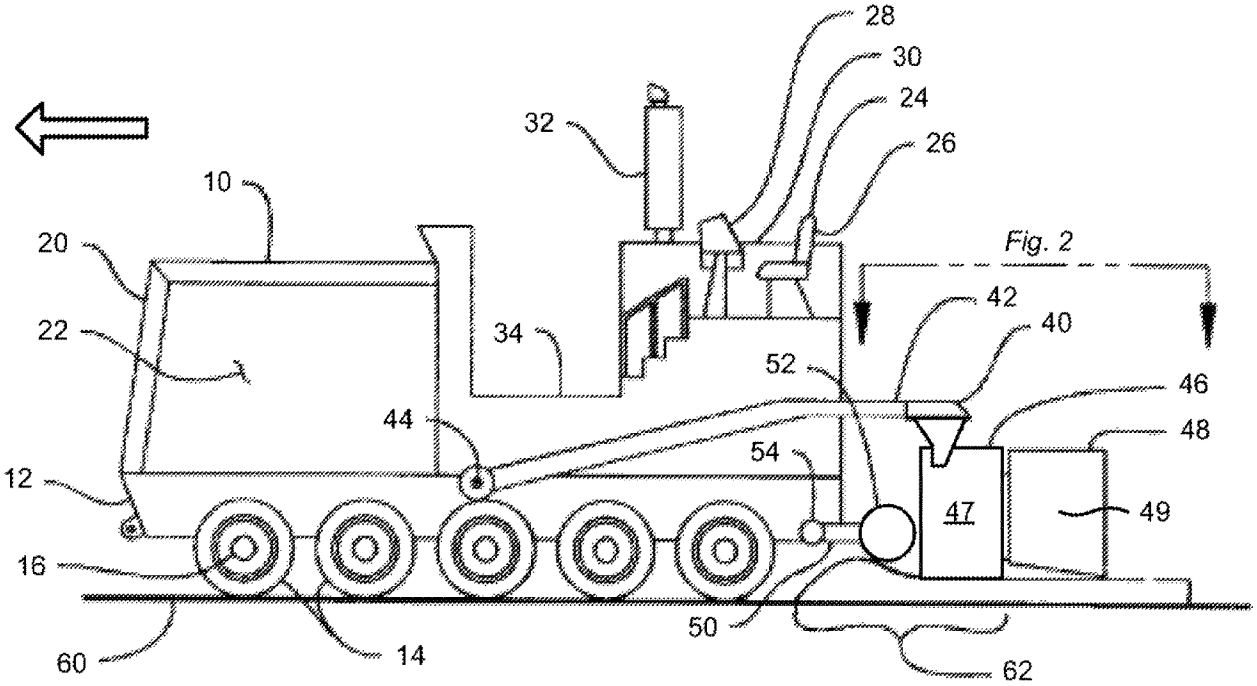
FIG. 1 is a diagram of an example paving machine that includes a rear mount screed assembly.

FIG. 1 is a diagram of an example paving machine 10 that includes a rear mount screed assembly 40. As shown, paving machine 10 may include a frame 12 that is supported by and transported upon a plurality of transport wheels 14 oppositely disposed on axles 16 that extend underneath frame 12 transverse to a direction of motion of paving machine 10. A hopper 20 may be disposed on a forward portion of frame 12. Hopper 20 may include sides 22 extending vertically from frame 12 so that hopper 20 can receive material (e.g., a fume-emitting bituminous aggregate material, such as asphalt) from a transport vehicle (e.g., a dump truck), and retain the material in hopper 20 pending disposition of the material on a surface to be paved by paving machine 10.

As shown, towards a rear of the frame 12, an operator station 24 may be provided so that an operator seated at a chair 26 can control operation of paving machine 10 by way of controls provided on a control panel 28. Also disposed toward the rear of the frame 12 may be an engine housing 30 on which is provided an exhaust stack 32 for exhausting combustion by-products of engine housing 30. As further shown, a walkway area 34 may be provided between hopper 20 and engine housing 30 in order to permit access by personnel (e.g., the operator, members of a paving crew, and/or the like) across paving machine 10, to engine housing 30, or to other machinery and components that may be disposed or mounted upon the paving machine 10.

As further shown in FIG. 1, a rear mount screed assembly 40 may be (e.g., pivotally) connected to frame 12 by a set of screed support arms 42. In some cases, the set of screed support arms 42 may be substantially parallel and horizontal to one another, being disposed along frame 12 and pivotally connected to frame 12 at arm pivot 44, which has a horizontal axis transverse to the direction of travel of paving machine 10, thus permitting vertical movement of rear mount screed assembly 40. While not shown, paving machine 10 may include a means by which vertical movement of rear mount screed assembly 40 is limited and/or controlled. Rear mount screed assembly 40 as shown is comprised of a main screed 46 and screed extensions 48 which are disposed behind and approximately parallel to main screed 46. In some implementations, main screed 46 may have angled end faces 47, as shown and described below in association with FIG. 2. In some implementations, screed extensions 48 may include endgates 49 mounted there, as shown and described below in association with FIG. 2.

As further shown, paving machine 10 may further include an aggregate disposition means 50. Aggregate disposition means 50 may include an auger 52 (e.g., a flighted auger) disposed adjacent a rear of frame 12 in an approximate horizontal and axially transverse position with respect to the direction of travel of paving machine 10. As further shown, an auger support means 54 may be arranged for controlling a position of aggregate disposition means 50.

As indicated above, FIG. 1 is provided as an example. Other examples are possible and may differ from what was described in connection with FIG. 1. In other words, paving machine 10, the components shown as being included in paving machine 10, and the arrangement of these components, are provided for illustrative purposes only. Also, FIG. 1 does not illustrate scale representations of paving machine 10 and/or the components shown as being included in paving machine 10. Rather, paving machine 10, as described herein is not intended to be limiting, but is intended to be illustrative of apparatus and applications in which the present invention may be employed. For example, although paving machine 10 is described as a wheel-type paver, the implementations described herein may be equally suitably employed on a track-type paver.

Figure 2:
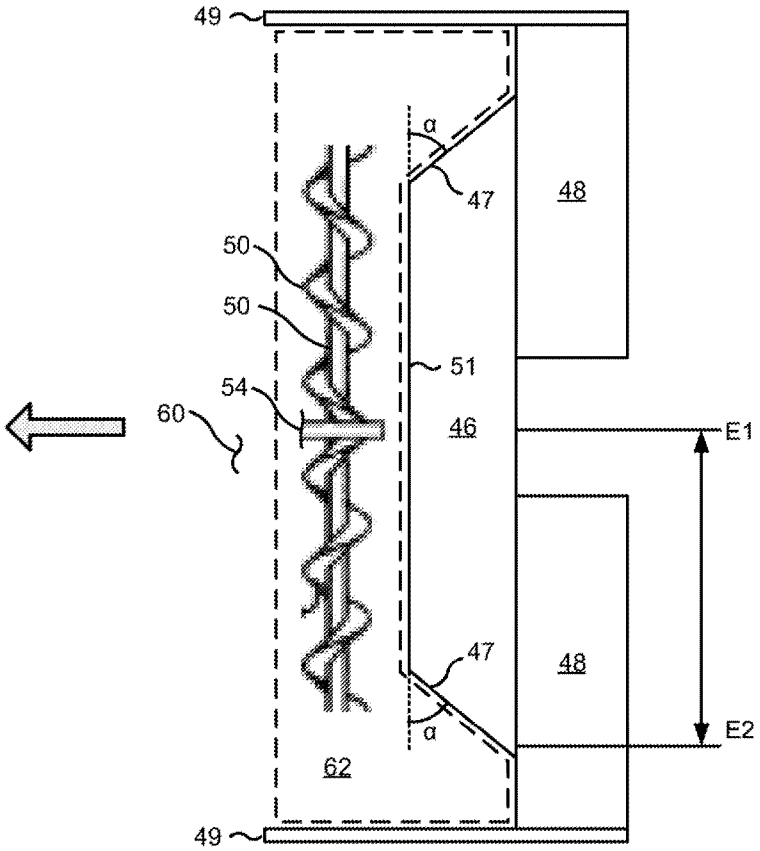
FIG. 2 is a diagram of an example rear mount screed assembly, including a main screed with angled end faces, that may be used in the paving machine of FIG. 1.

FIG. 2 is a diagram of a top view of an example rear mount screed assembly 40, including main screed 46 with angled end faces 47, that may be used in paving machine 10. For purposes of clarity, some components shown and described in association with FIG. 1 are omitted from FIG. 2.

As described above, paving machine 10 may operate on and along a prepared roadbed surface 60 with hopper 20 facing the direction of travel so as to receive and contain a material. With reference to FIG. 2, a quantity of the material may be deposited (e.g., at a selected volumetric flow rate) from paving machine 10 in a section of material reservoir 62 preceding main screed 46. Aggregate disposition means 50 (e.g., auger 52) may operate to move a portion of the material toward ends of main screed 46 (e.g., away from a center of main screed 46) such that the material flows toward an area of material reservoir 62 preceding screed extension 48. A position of each screed extension 48 may be variable, and may be selected (e.g., by the operator) to be at a position between a minimum extension E1 and a maximum extension E2 such that the coverage area of material reservoir 62 can be varied. The position of each screed extension 48 may be independent (e.g., such that each screed extension 48 may be independently extended to a different length).

As shown in FIG. 2, main screed 46 may include end faces 47 that are angled with respect to a front face 51 such that an angle $\alpha$ (e.g., an angle from a plane of front face 51 to a plane of angled end face 47) is less than 90 degrees. In other words, main screed 46 may include end faces 47 that are angled such that main screed 46 does not include a sharp (e.g., 90 degree, square, and/or the like) corner between an end face and front face, as is the case with typical main screeds. Put another way, main screed 46 may include an end face 47 that is non-perpendicular to front face 51 of main screed 46. In some implementations, angle $\alpha$ may be any angle that is less than 90 degrees (e.g., 75 degrees, 60 degrees, 45 degrees, 30 degrees, 15 degrees, and/or the like). In some implementations, the angle α may be in a range from approximately 60 degrees to approximately 30 degrees, from approximately 75 degrees to approximately 15 degrees, and/or the like.

In some implementations, as indicated in FIG. 2, angles between end faces 47 and front face 51 may be approximately equal to one another (e.g., the angled end faces 47 may have the angle α relative to front face 51 or may match within a threshold amount). Alternatively, end faces 47 may be differently angled relative to front face 51, in some implementations.

Figure 3:
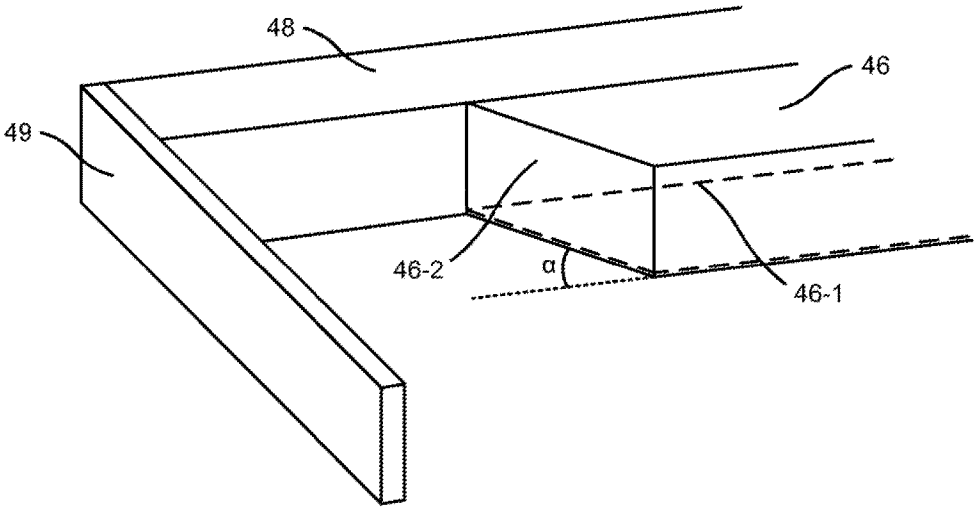
FIG. 3 is a diagram of an example implementation of an angled end face of a main screed.
Figure 4:
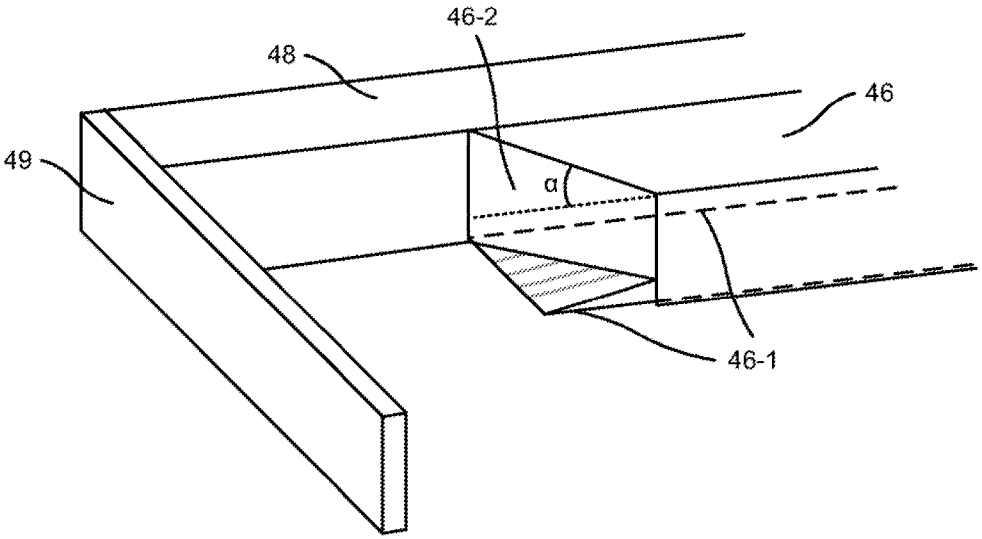
FIG. 4 is a diagram of another example implementation of an angled end face of a main screed.

With reference to FIGS. 3 and 4, in some implementations, the angled end face 47 may be formed by a screed plate 46-1 of main screed 46 (e.g., the screed plate 46-1 may be an angled screed plate). Additionally, or alternatively, the angled end face 47 may be formed by an end cap 46-2 of main screed 46 (e.g., the end cap 46-2 may be an angled end cap). In some implementations, the angled end face 47 may be formed by both the screed plate 46-1 and the end cap 46-2 of main screed 46.

FIG. 3 is a diagram illustrating an example main screed 46 in which angled end face 47 is formed by an angled screed plate 46-1 (outlined by dashed lines on the bottom of main screed 46 in FIG. 3) and an angled end cap 46-2 (a left-most face of main screed 46 in FIG. 3). As shown in FIG. 3, in this example, both the screed plate 46-1 and the end cap 46-2 are angled in order to form angled end face 47.

FIG. 4 is a diagram illustrating an example main screed 46 in which angled end face 47 is formed by an angled end cap 46-2 (a left-most face of main screed 46 in FIG. 4), while screed plate 46-1 has a squared corner. As shown in FIG. 4, in this example, only end cap 46-2 forms angled end face 47. As shown, screed plate 46-1 may be formed in order to permit formation of angled end face 47 by end cap 46-2 only.

In some implementations, the angled end faces 47 of main screed 46 improve material flow around and/or near the angled corner of main screed 46 during operation of paving machine 10, as described below.

As indicated above, FIG. 2 is provided as an example. Other examples are possible and may differ from what was described in connection with FIG. 2. In other words, the number and arrangement of components shown for rear mount screed assembly 40 are provided for illustrative purposes only, and FIG. 2 does not illustrate scale representations of rear mount screed assembly 40 or components of rear mount screed assembly 40. Rather, rear mount screed assembly 40, as described herein is not intended to be limiting, but is intended to be illustrative of apparatus and applications in which implementations described herein may be employed.

INDUSTRIAL APPLICABILITY

The disclosed main screed with angled end faces may be used with any rear mount screed in which improved material flow and/or reduced component wear is desired, such as a paving machine 10.

In operation, an angled corner of main screed 46 (a corner of main screed 46 that is formed by an angled end face 47 and front face 51) improves material flow (e.g., as compared to a main screed including a sharp corner) by providing a comparatively more natural pathway for material flow. This more natural material flow may reduce material pinching between the angled end face 47 and endgate 49, meaning that component wear and/or material segregation at or near the angled corner of main screed 46 is also reduced (e.g., as compared to a main screed including a sharp corner). Further, due to the reduced material pinching afforded by the improved material flow at or near the angled corner of main screed 46, a likelihood that screed extension 48 will bind, stall, and/or otherwise be rendered unable to retract to a desired position is reduced (e.g., since, during retraction, the improved material flow may alleviate material compression between endgate 49 and angled end face 47).

In other words, the disclosed main screed 46 with angled end faces 47 provides a number of advantages, such as improved material flow at or near an angled corner of main screed 46, reduced material segregation at or near the angled corner of main screed 46, reduced component wear associated with one or more components of rear mount screed assembly 40, a reduced likelihood of binding, stalling, and/or the like, during retraction of screed extension 48, any of which can improve quality of a surface paved using paving machine 10.

As used herein, the articles "a" and "an" are intended to include one or more items, and may be used interchangeably with "one or more." Also, as used herein, the terms "has," "have." "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations are possible in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of possible implementations. Although each dependent claim listed below may directly depend on only one claim, the disclosure of possible implementations includes each dependent claim in combination with every other claim in the claim set.

What is claimed is:

1. A paving machine, comprising:

a rear mount screed assembly including a main screed and a screed extension, the main screed including a front face and an angled end face, wherein an angle between a plane of the front face of the main screed and a plane of the angled end face of the main screed is less than 90 degrees, and the screed extension being behind the main screed relative to a direction in which the paving machine is to travel during operation.

2. The paving machine of claim 1, wherein the angled end face is formed by a screed plate of the main screed.

3. The paving machine of claim 1, wherein the angled end face is formed by an end cap of the main screed.

4. The paving machine of claim 1, wherein the angled end face is formed by a screed plate of the main screed and an end cap of the main screed.

5. The paving machine of claim 1, wherein the angle is in a range from approximately 60 degrees to approximately 30 degrees.

6. The paving machine of claim 1, wherein the screed extension is a first screed extension, the angled end face is a first angled end face, and the angle is a first angle, wherein the main screed further includes a second angled end face, wherein a second angle between the plane of the front face of the main screed and a plane of the second angled end face of the main screed is less than 90 degrees.

7. The paving machine of claim 6, wherein the first angle is approximately equal to the second angle.

8. A rear mount screed assembly, comprising:

a main screed comprising a front face and an angled end face, wherein an angle between a plane of the front face of the main screed and a plane of the angled end face of the main screed is less than 90 degrees; and a screed extension arranged behind the main screed relative to a direction in which the rear mount screed assembly is to be moved during operation.

9. The rear mount screed assembly of claim 8, wherein the angled end face is formed by a screed plate of the main screed.

10. The rear mount screed assembly of claim 8, wherein the angled end face is formed by an end cap of the main screed.

11. The rear mount screed assembly of claim 8, wherein the angled end face is formed by a screed plate of the main screed and an end cap of the main screed.

12. The rear mount screed assembly of claim 8, wherein the angle is less than approximately 75 degrees.

13. The rear mount screed assembly of claim 8, wherein the screed extension is a first screed extension, the angled end face is a first angled end face, and the angle is a first angle, wherein the main screed further comprises a second angled end face, wherein a second angle between the plane of the front face of the main screed and a plane of the second angled end face of the main screed is less than 90 degrees.

14. The rear mount screed assembly of claim 13, wherein the first angle matches the second angle.

15. A screed assembly, comprising:

a main screed and a screed extension, wherein the main screed includes a front face and an end face, wherein the end face is angled such that the end face is non-perpendicular to the front face of the main screed, and wherein the screed extension is arranged behind the main screed relative to a direction in which the screed assembly is to be moved during operation.

16. The screed assembly of claim 15, wherein the end face is formed by a screed plate of the main screed.

17. The screed assembly of claim 15, wherein the end face is formed by an end cap of the main screed.

18. The screed assembly of claim 15, wherein the end face is formed by a screed plate of the main screed and an end cap of the main screed.

19. The screed assembly of claim 15, wherein the end face is angled such that an angle between a plane of the front face and a plane of the end face is in a range from approximately 30 degrees to approximately 60 degrees.

20. The screed assembly of claim 15, wherein the screed extension is a first screed extension and the end face is a first end face, wherein the main screed further comprises a second end face, wherein the second end face is angled such that the second end face is non-perpendicular to the front face of the main screed.

* * * * *